United States Patent [19]

Anderson

[11] Patent Number: 4,726,299

[45] Date of Patent: Feb. 23, 1988

[54] METHOD AND APPARATUS FOR CONTROLLING A VEHICLE

[75] Inventor: John E. Anderson, Minneapolis, Minn.

[73] Assignee: Regents of the University of Minnesota, Minneapolis, Minn.

[21] Appl. No.: 832,028

[22] Filed: Feb. 20, 1986

[51] Int. Cl.[4] ..... B61J 3/00

[52] U.S. Cl. ..... 104/88; 104/295

[58] Field of Search ..... 104/88, 28, 27, 295, 104/299, 18, 20, 25, 27

[56] References Cited

U.S. PATENT DOCUMENTS

| | | | |
|---|---|---|---|
| 3,893,397 | 7/1975 | Gayot | 104/27 X |
| 3,895,584 | 7/1975 | Peddison | 104/88 |
| 3,933,099 | 1/1976 | Sieb | 104/88 |

FOREIGN PATENT DOCUMENTS

| | | | |
|---|---|---|---|
| 620941 | 12/1976 | U.S.S.R. | 104/88 |

OTHER PUBLICATIONS

Jack H. Irving, Fundamentals of Personal Rapid Transit, Subchapter of Chapter 4 entitled "Centralization Versus Decentralization", p. 110.

Jack H. Irving, Fundamentals of Personal Rapid Transit, Subchapter of Chapter 4 entitled "Control of Switching", p. 121.

Jack H. Irving, Fundamentals of Personal Rapid Transmit, Chapter 5 entitled "Routing and Empty Vehicle Management", p. 134.

Personal Rapid Transit III, University of Minn., (1976), paper entitled "Vehicle Management on Large PRT Networks" authored by Jack H. Irving, et al., p. 345.

Personal Rapid Transit III, University of Minn. (1976), paper entitled "Systems Management Analysis of Large AGT Networks" authored by Martin S. Ross, et al., p. 369.

*Primary Examiner*—Robert B. Reeves

*Assistant Examiner*—Glenn B. Foster

*Attorney, Agent, or Firm*—Merchant, Gould, Smith, Edell, Welter & Schmidt

[57] ABSTRACT

A method and apparatus for controlling movement of a vehicle through a network is disclosed. The network has a plurality of stations interconnected by a plurality of path segments. A plurality of branch points connect the path segments and require a vehicle approaching a branch point to be directed in either a first or second direction. Line-defining parameters are provided for each of the branch points and define a network-dividing line which divides the plurality of stations into a first set which are attainable by a vehicle being directed in a first direction and a second set attainable by a vehicle being directed in a second direction. Coordinates of a destination station are associated with a vehicle. As the vehicle approaches a branch point, the coordinates of the destination station are compared to the line-defining parameters of the approaching branch point and the destination station is determined to be in either the first set or the second set. The vehicle is directed in a first direction if the destination station is determined to be in the first set and in a second direction if the station is determined to be in a second set.

12 Claims, 15 Drawing Figures

FIG. 1
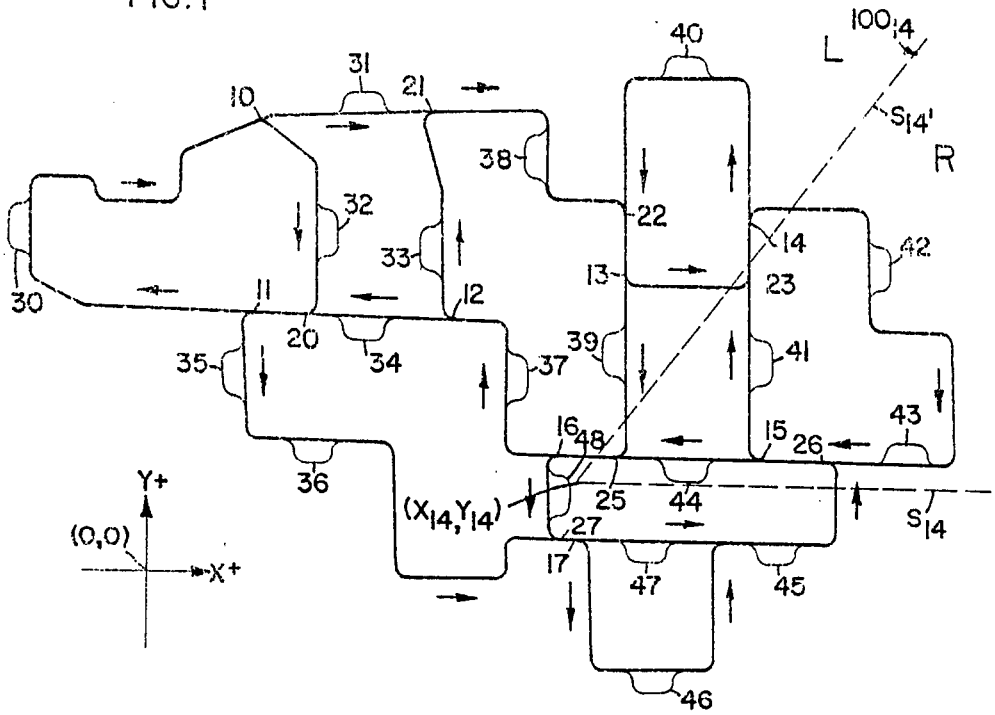
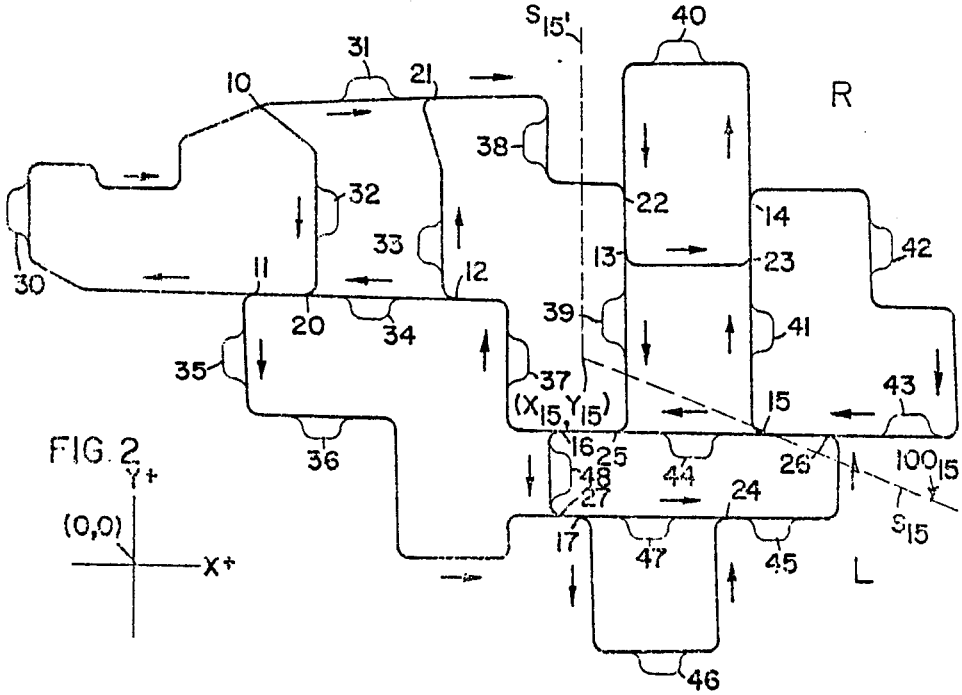
FIG. 2

FIG. 3
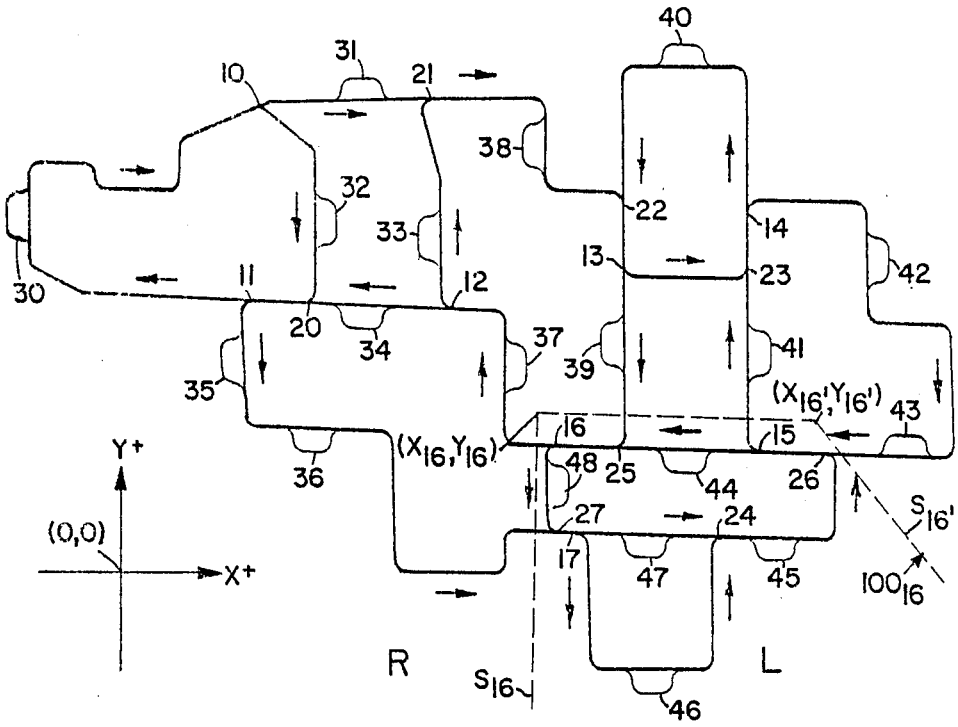
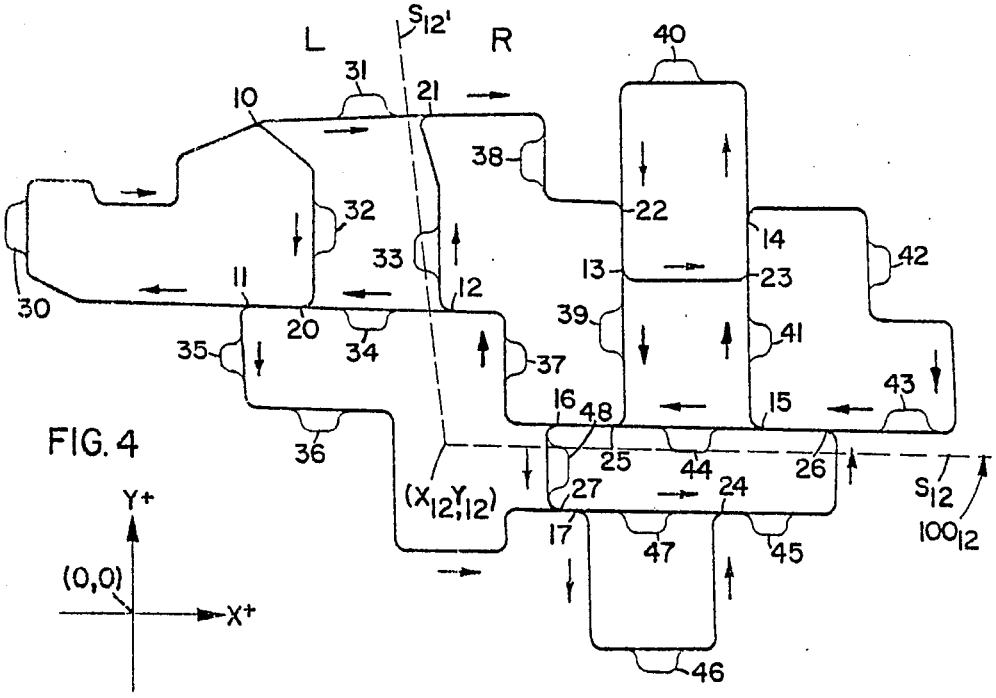
FIG. 4

FIG. 5
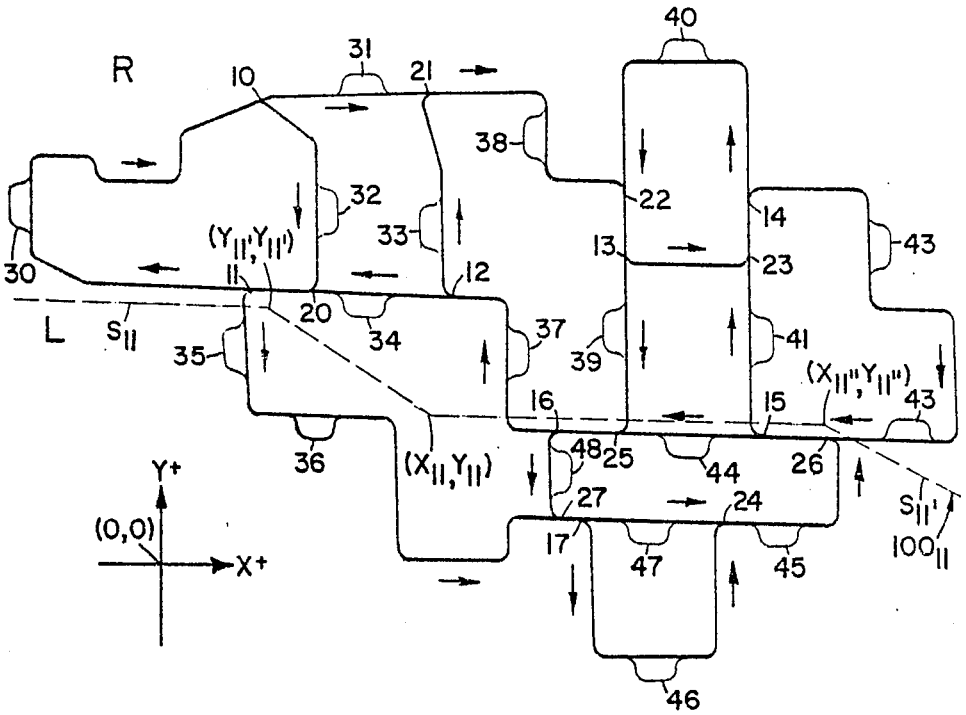
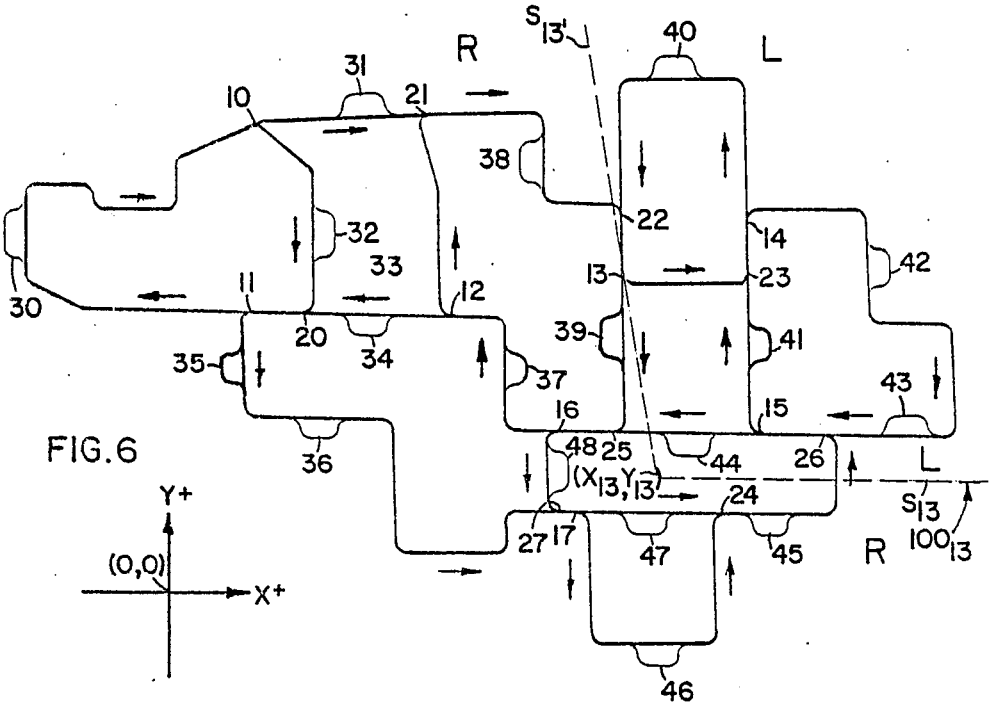
FIG. 6

FIG. 7
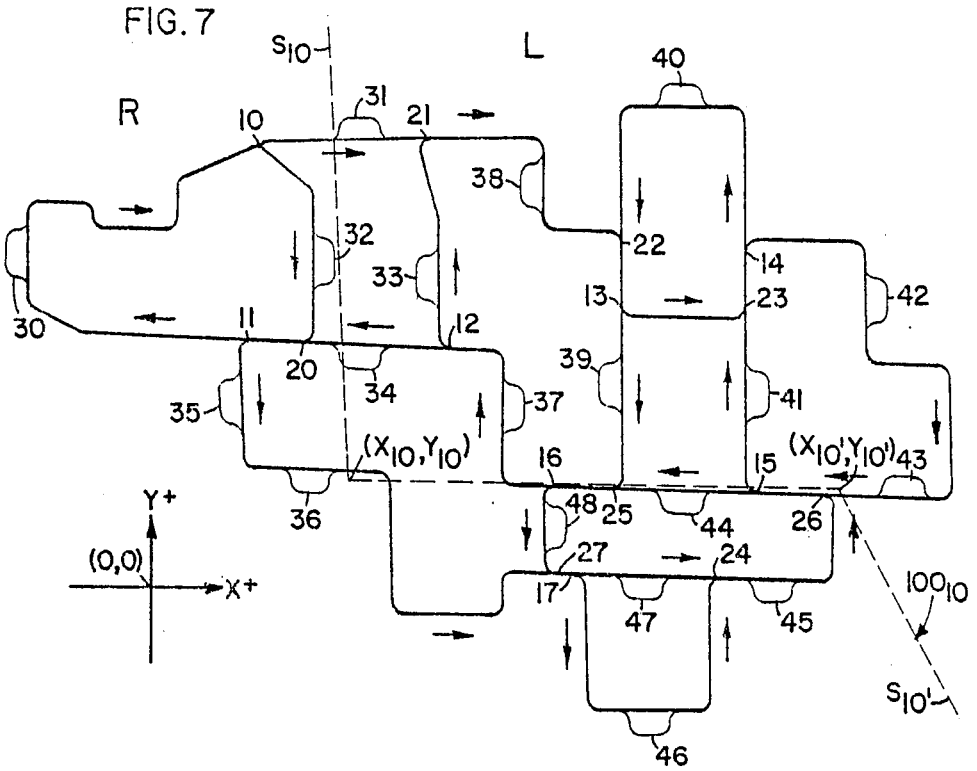
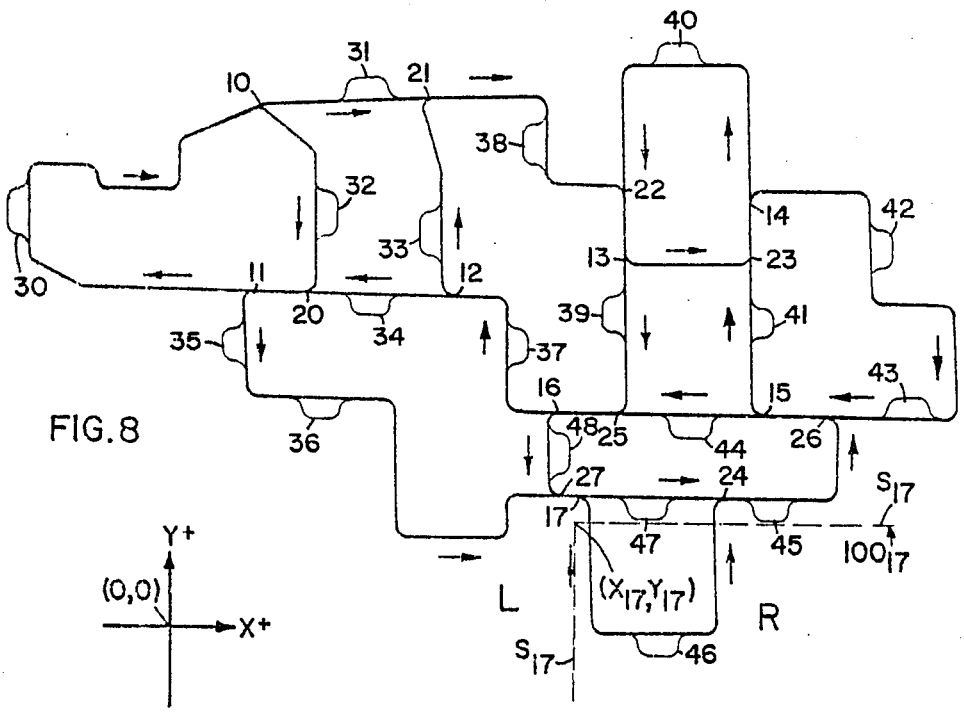
FIG. 8

FIG. 9
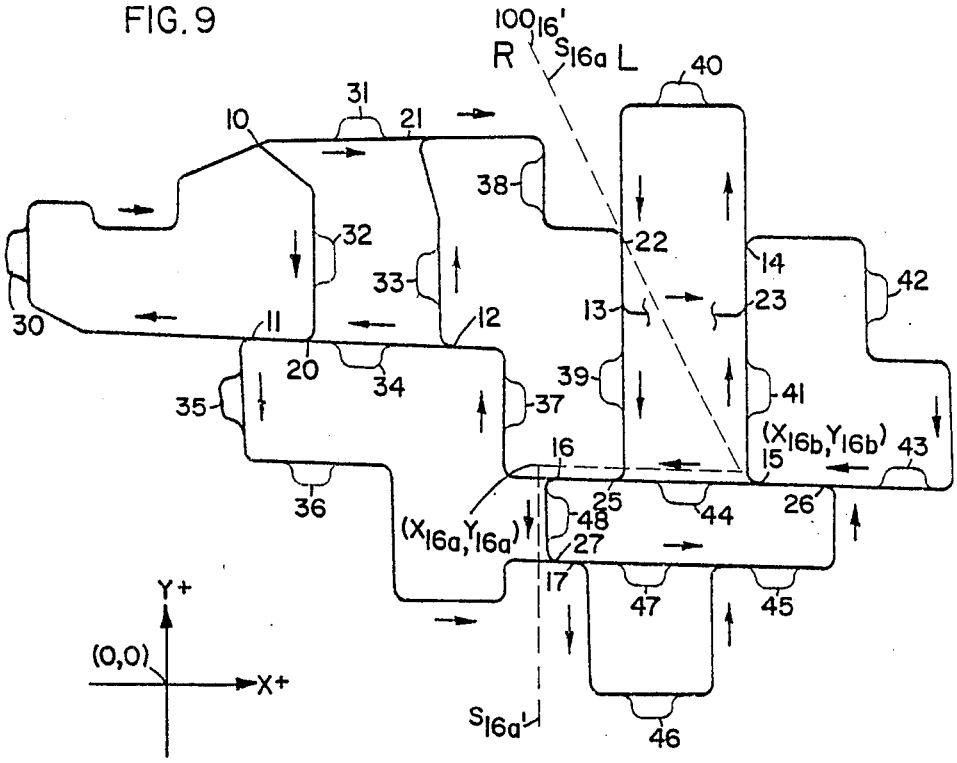
FIG.10
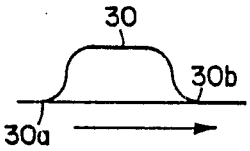
FIG.11
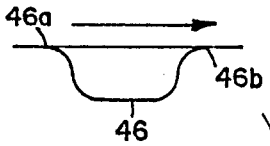
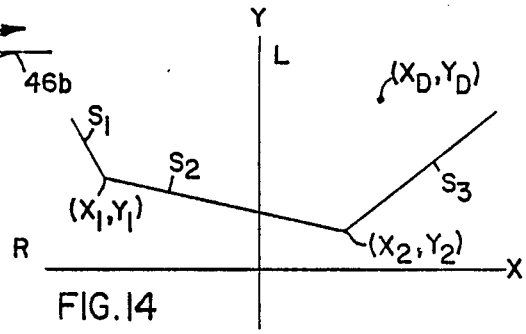
FIG.14

METHOD AND APPARATUS FOR CONTROLLING A VEHICLE

BACKGROUND OF THE INVENTION

I. Field of the Invention

This invention pertains to transportation networks and more particularly to a method and apparatus for controlling the movement of a vehicle through a transportation network.

II. Description of the Prior Art

A need for a fuel efficient economical rapid transit system exists. The current state of mass transit systems includes busses and railway systems as well as underground subway trains and elevated trains and the like. All of these systems attempt to move large numbers of people in large vehicles. As a result, the vehicle must stop at a plurality of stations to allow passengers to embark and disembark as desired. Therefore, the effective average speed of the vehicle is reduced by the constant. stopping and starting. Most riders make numerous stops between their point of origin and their intended destination.

A personal rapid transit system would eliminate several of the above problems since each vehicle carries a small number of passengers desiring to go to the same destination. As a result, each vehicle bypasses all intermediate stops. Therefore, the average speed of the vehicle can be greatly increased while its maximum speed remains the same. Delays associated with stopping at intermediate points are eliminated. The advantages of a personal rapid transit system have been known to those skilled in the art. However, construction of such a system and its method of operation have been elusive.

A personal rapid transit system having individual cars which move about a common track or guideway is shown in my commonly assigned U.S. Pat. No. 4,522,128 issued June 11, 1985. Also, further improvements and details in the vehicle and guideway are shown and described in commonly assigned U.S. Pat. Nos. 4,671,185 issued June 9, 1987; and 4,665,830 issued May 19, 1987 and U.S. Pat. No. 4,665,829 issued May 19, 1987 on application Ser. No. 890,881 continuation of Ser. No. 463,951 filed Feb. 4, 1983, now abandoned. The aforementioned patents teach a vehicle sized for a small number of passengers which is moved along a guideway. The aforesaid U.S. Pat. No. 4,665,830 enumerates several articles which generally discuss transit systems.

The development of a personal rapid transit system presents certain problems with respect to the apparatus and method for controlling movement of vehicles from an origin to a destination. For example, a personal rapid transit system having vehicles which are to be guided by computers must have a method of operation which is sufficiently flexible for the vehicle to be able to direct itself to any possible destination station from any possible origin station. Possible solutions to the method and apparatus for controlling movement of such vehicles would include having each vehicle with on-board computers which have a complete memory of the entire transportation network and is pre-programmed such that at any given origin station it knows the proper direction to take at any one of a plurality of junction points throughout the network on way to a destination station. However, such a scheme for operating the control of a mass transit system requires a substantial amount of programming logic. Also, once the logic has been established, it is not easily modified. Therefore, such a system is not sufficiently flexible in the event of congestion in any specific location on the network to adapt to the congestion to re-route vehicles. Also, if the network is expanded or otherwise modified, the logic programs must be modified and rewritten. This is a costly practice and may make a personal rapid transit system prohibitively expensive.

An alternative to on-board memorization of the transit network is to have centralized memorization with a central computer controlling movement of the vehicles with means for providing communication between the vehicle and the central logic unit. Information to be transmitted would include information from the vehicle indicating its location and desired destination. The central computer would transmit to the vehicle the sequence of turns necessary at all approaching junctions needed to arrive at the desired destination. The vehicle would necessarily have an on-board microprocessor to accept the variety of information received from the central logic unit and use this information to effect operation of on-board switching devices. The problem associated with the extensive use of a centralized computer is that a substantial amount of information must be exchanged between the vehicle and the central computer on a regular basis. As the amount of necessary information transfer increases, the possibility of an error in tranmission increases. One possible source of such errors would be noise in the transmission.

It is recognized that the probability of error in a transmission of information can be extremely low if the amount of information being transferred is minimal. However, in transit systems that have a plurality of stations and a wide variety of routes connecting the stations, the amount of information which would be transmitted to a vehicle as to the sequence of turns it must take to achieve its destination can become extremely large such that the possibility for error in a transmission is not acceptable.

OBJECTS AND SUMMARY OF THE INVENTION

It is the object of the present invention to provide a method and apparatus for controlling the movement of a vehicle through a network.

A further object of the present invention is to provide a method and apparatus for controlling the movement of a vehicle through a network where information is transmitted from a stationary point to the vehicle to provide the vehicle with information necessary to determine the direction the vehicle should take at a network junction point.

A yet further object of the present invention is to provide a method and apparatus for controlling the movement of a vehicle through a network and requiring a minimal amount of information transfer between the moving vehicle and a stationary information source.

According to a preferred embodiment of the present invention, there is provided a method and apparatus for controlling the movement of a vehicle through a network. The network includes a plurality of stations interconnected by a plurality of path segments. A plurality of juncture points connects the path segments and includes a plurality of branch points which require a vehicle approaching a branch point to be directed in either a first or second direction. The method of the invention includes the steps of establishing a coordinate system for the network and assigning location-defining coordinates to each of the stations. Line-defining parameters are identified for each of the branch points with the parameters defining a network dividing line which divides the network into a plurality of stations which include a first set of stations obtainable by a vehicle being directed in a first direction at the branch point and a second set of stations obtainable by a vehicle being directed in a second direction at the branch point. A vehicle is assigned the location-defining coordinates of a destination station and is moved along a path segment toward an approaching branch point. The coordinates of the destination station and the line defining parameters at the branch point are compared to determine if the destination station is a member of a first set or a second set for that branch point. The vehicle is directed in a first direction if the destination station is determined to be a member of the first set and in a second direction if the destination station is determined to be a member of the second set.

BRIEF DESCRIPTION OF THE DRAWINGS

FIGS. 1–8 show, in schematic format, a transportation network with a plurality of stations interconnected by a plurality of path segments;

FIG. 9 is a schematic view of the transportation network of FIGS. 1 through 8 with one of the path segments broken;

FIG. 10 is an enlarged view of a schematic of a station on a network having a left-handed entrance;

FIG. 11 is an enlarged schematic view of a station for a network having a right-handed entrance;

FIG. 14 is a graphical view of a network dividing line.

DESCRIPTION OF THE PREFERRED EMBODIMENT

Figure 12:
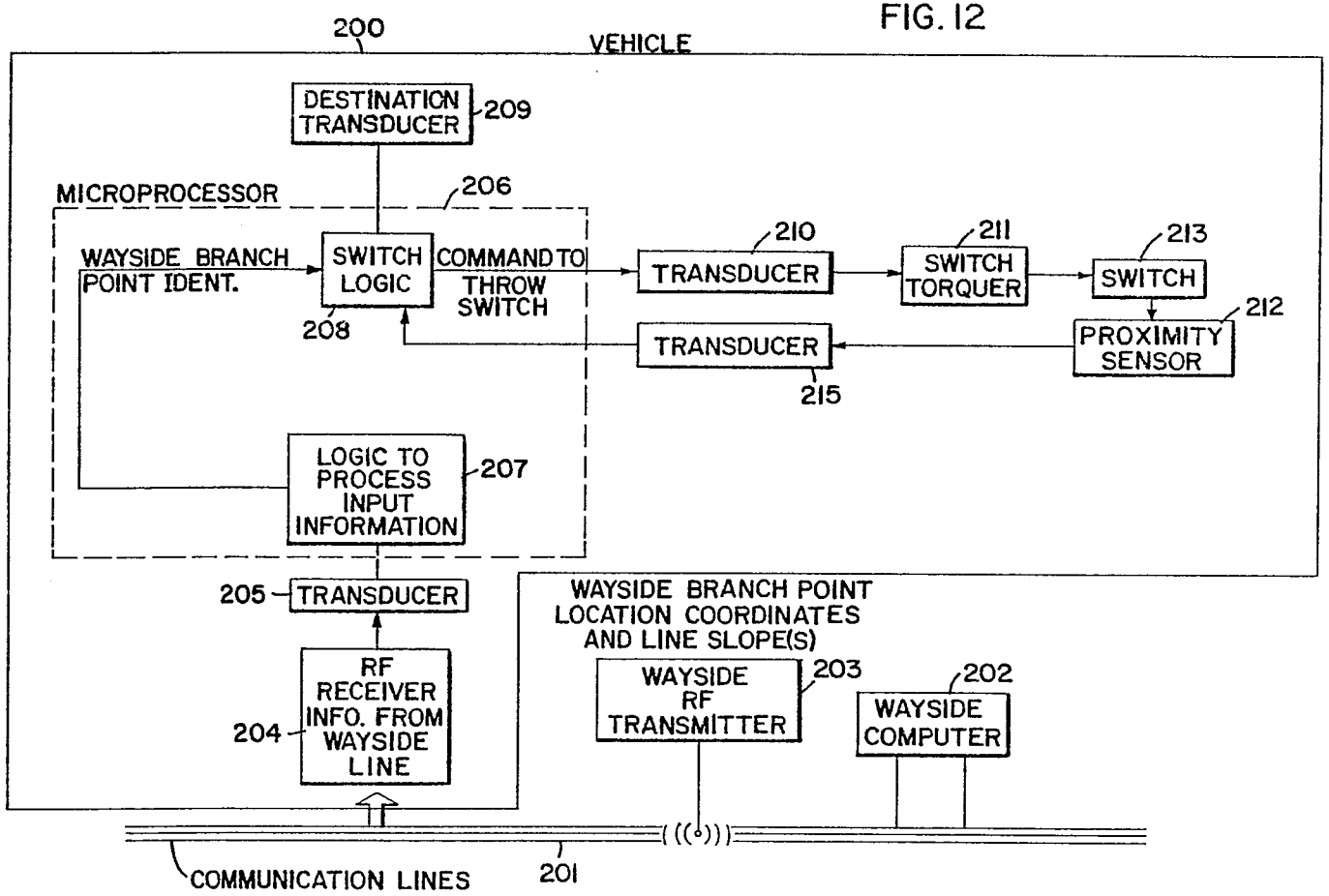
FIG. 12 is a block diagram showing transmitting, receiving and computing means for the present invention.

In FIGS. 1–8, the solid lines schematically show a transportation network. The transportation network is identical in each of FIGS. 1–8. The network includes a plurality of stations schematically shown at numerals 30–48, inclusive. The stations 30–48 are interconnected by a plurality of path segments indicated by the solid lines extending between a plurality of juncture points indicated by the numerals 10–17 and 20–27. The path segments are unidirectional and a vehicle on a path segment may only move in a direction indicated by the arrows adjacent the segments in the figures.

As noted above, the path segments are the solid lines extending between juncture points 10–17 and 20–27. The plurality of juncture points may be divided into separate groups including a plurality of merge points 20–27 and branch points 10–17. A merge point is any juncture point which receives vehicle traffic from two path segments and merges the vehicle traffic into a single path segment exiting the merge point. For example, with reference to merge point 26, traffic enters merge point 26 from either of branch segments extending between juncture points 14 and 26 and juncture points 24 and 26. The vehicle traffic which enters merge point 26 may only exit through the path segment extending between juncture points 15 and 26.

A branch point is defined as a juncture point where vehicles entering the branch point may arrive from only one path segment but may exit the branch point on any one of two path segments. For example, with reference to branch point 12, it can be seen that vehicle traffic enters branch point 12 only from the path segment between points 12 and 16. Traffic leaving branch point 12 may leave on the path segment extending between point 12 and point 21. Alternatively, traffic may leave branch point 12 on the path segment extending between points 12 and 20.

As shown in the figures, there are a plurality of network stations 30–48 located at various points along the network. The stations are schematically shown as waysides on path segments. Best shown in FIGS. 10 and 11, the stations will be described with reference stations 30 and 46. Station 30 is disposed on the path segment extending between juncture points 11 and 10. Associated with station 30 are two juncture points 30*a* and 30*b*. When a vehicle is approaching station 30 on the path segment and if station 30 is its destination station, the vehicle moves off the path segment at juncture point 30*a* which will conveniently be referred to as a "station-on" point. A vehicle leaving station 30 must pass through juncture point 30*b* to return to the path segment. Station 30*b* will conveniently be referred to as a "station-off" point. Station 46, which is shown enlarged in FIG. 11, also includes a station-on point 46*a* and a station-off point 46*b*. FIGS. 10 and 11 differ in that station 30 of FIG. 10 is a left-handed station in that a vehicle approaching the station must exit to the left at station-on point 30*a*. To leave station 30 and return to the path segment, a vehicle must approach the path segment from the left at station-off point 30*b*. As shown in FIG. 11, station 46 is a right-handed station in that a vehicle entering station 46 from the path segment exits to the right at station-on point 46*a*. A vehicle at station 46 entering the path segment approaches the path from the right at station-off point 46*b*. It can be seen from the above that station-off points 30*b* and 46*b* operate like merge points.

A plurality of left-handed stations such as station 30 are disposed on the network and includes stations 30, 31, 32, 33, 34, 42, 44, 48. The remaining stations are right-handed stations such as station 46.

A network like that described above can be used in a plurality of transit systems such as personal transit systems as well as material handling systems. Preferably, the network of the present invention is described in reference to a personal rapid transit system having vehicles and guideways described in the aforementioned commonly assigned U.S. patents. In this embodiment, the pathways will be formed of the guideways disclosed in these references. For example, with reference to U.S. Pat. No. 4,522,128 (which is incorporated herein by reference), a vehicle 10 is shown in a guideway 12. The vehicle has wheels 22 which rest on channels 18 to provide verticle support for the vehicle 10. A plurality of guide wheels 28 bear against channels 29 to provide lateral support as the vehicle moves on a path segment extending between juncture points. Again with reference to the the figures of U.S. Pat. No. 4,522,128, and also with reference to the disclosure of the patent, the vehicle 10 includes a switch arm 32 which is pivotable between a left switch position and a right swith position. As a vehicle is approaching a branch point, the switch arm 32 must be switched to the left position if a left turn is desired or to the right position if a right turn is desired. Likewise, this procedure must be followed as the vehicle approaches a station-on point. If the vehicle is approaching a left-handed station and it is desired to enter the station, the switch must be in the left position. If it is not desired to enter the station, the switch must be in the right position. Conversely, if the vehicle is approaching a right-handed station and it is desired to enter the station, the switch must be in the right position. If it is not desired to stop at the right-handed station, the switch must be in the left position. Finally, as a vehicle is approaching a merge point, the switch must be in the left position if the vehicle is approaching from the left. The switch must be in the right position if the vehicle is approaching the merge point from the right.

In a personal rapid transit system having a network such as that shown in the figures, it will be appreciated the stations could represent a wide variety of differing locations within a community. For example, stations 30, 40, 42 and 46 could represent stations adjacent parking lots in residential neighborhoods. Stations 39, 41 and 37 could represent centralized urban areas which include business, government and educational areas. The remaining stations could represent any one of a variety of areas such as residential areas and shopping areas. It will be apparent that an individual or a small group of individuals entering a personal vehicle at anyone of stations 30–48 could desire to go to anyone of the remaining stations. Therefore, at any given time there can be a plurality of individual vehicles moving around the path segments heading to a wide variety of destination stations. Additionally, in response to anticipated needs for vehicles at a given station, it would be desirable to move vehicles from a station having a large number of empty vehicles but low anticipated vehicle need to a station having a low number of empty vehicles but a high level of anticipated vehicle need. Therefore, in addition to having a plurality of occupied vehicles moving to a plurality of randomly determined destination points, there can also be a random number of empty vehicles moving toward a plurality of randomly determined stations.

As a vehicle moves from a point of origin to a point of destination, it is probable the vehicle will pass through a plurality of juncture points. At each one of these juncture points, the vehicle must be in either a right switch or a left switch orientation. As previously noted, the vehicle can be programmed at its point of origin for any given destination point to be instructed to make the proper sequence of left and right switching throughout the network to obtain its destination point through the most efficient path. However, such a scheme either involves the vehicle being provided with on-board programming having the proper sequences of left and right switching for every destination conceivable from every possible point of origin. Alternatively, the sequencing scheme can be relayed to an on-board computer from a central computer. However, either of these alternative is undesirable. Neither of these alternatives adequately provides for the possibility to reprogram the vehicle once travel is initiated. Such a need may result due to congestion in a given path segment or due to damage or accident on a path segment. Also, the scheme involving the central computer requires transfer from the central computer to the vehicle of a wide variety of information. Namely, the vehicle must be informed of every station along its way and whether or not it is a left-handed station or a right-handed station. Likewise, the vehicle must be informed of all merge points along its path and whether or not the merge point will require a left-handed or right-handed switch. Finally, the vehicle must be informed of every branch point along its path and instructed as to whether or not the vehicle should branch to the left or the right. It will be appreciated that in personal transit systems for urban areas, the networks will be substantially larger than those shown in the figures. As a result, the amount of information which must be transferred to the vehicle can become enormous. As the amount of information increases, the probability of error in transmission becomes intolerably high.

Another problem associated with the above schemes is the method of controlling the vehicle must acknowledge the possibility that the network will change over time. For example, new path segments may be added and old path segments deleted. Also, stations can be added or subtracted from given path segments. Each one of these changes requires substantial reprogramming of either the on-board computer or the central computer. Such programming can become extremely expensive.

In order to effectively control the movement of a vehicle in such networks with a minimum amount of information transfer between a stationary source of information and the vehicle, the present invention has been conceived. With respect to the branch points 10–17, it will be appreciated that as a vehicle approaches each of these branch points, a decision is required as to whether the vehicle should be in a left switch mode or a right switch mode. I have determined that this can be accomplished by dividing the plurality of stations into two sets for each branch point. The first set will include those stations which are most efficiently attained by a taking a left turn at the branch point. The second set will include those stations which are most efficiently attained by taking a right turn at the branch point. At each branch point, a determination is made whether the destination station is in the first set or the second set and a left turn or right turn is made accordingly. To this end, a coordinate system is established for the network. In each of FIGS. 1–9, a Cartesian coordinate system is superimposed including orthogonal X and Y axes intersecting at a predetermined reference point (0,0). It will be appreciated that while a Cartesian coordinate system is preferred, any other coordinate system, such as radial coordinates, may be employed.

Each of the stations 30–48 is assigned a pair of location defining coordinates which may be algebraically referred to as $(X_i,Y_i)$ where i=30, 31, 32, . . . , 48. With location defining coordinates $(X_i,Y_i)$ assigned to each of the stations 30–48, a plurality of network dividing lines can be defined for each of the branch points 10–17. For example, with reference to FIG. 1, a network dividing line $\mathbf{100}_{14}$ shown as a dashed line is provided for branch point 14.

As can be seen, the network dividing line $\mathbf{100}_{14}$ includes two line segments with a first line segment having a slope $S_{14'}$ and passing through a point $(X_{14},Y_{14})$. The line also includes a second segment which passes through the same point and has a slope $S_{14}$. The network dividing line $\mathbf{100}_{14}$ is selected to divide the area of the network into two domains indicated by domain R and domain L. The positioning of the line $\mathbf{100}_{14}$ is selected such that the stations within domain R are most efficiently attainable by taking a right turn at branch point 14. In the case of FIG. 1, having determined that stations 41, 42, 43 and 44 are most efficiently attainable by taking a right turn at branch point 14 and that the remaining station are most efficiently attainable by taking a left turn at branch 14, line $100_{14}$ was drawn as shown and the parameters $S_{14'}$, $S_{14}$, $X_{14}$ and $Y_{14}$ are readily determinable with respect to the coordinate system.

It will be appreciated that the nature of the network dividing line will vary for each of the branch points. Accordingly, FIGS. 2, 3, 4, 5, 6, 7 and 8 show network dividing lines for branch points 15, 16, 12, 11, 13, 10 and 17, respectively. The positioning of the network dividing line for each of the branch points is established by identifying at each of the branch points those stations which are most efficiently attained by taking a right-hand turn at the branch point and those which are most efficiently attained by taking a left-hand turn at the branch point.

The network dividing line is provided as being a plurality of connected straight line segments separating the two sets of stations into the right-hand domain R of the network and the left-hand domain L of the network for that branch point. Whether a station is considered most efficiently attainable by a right or left turn will depend upon a variety of factors for the particular network such as the length of the path segments and anticipated traffic. With reference to the figures, it can be seen that each of the dividing lines is uniquely defined by the coordinates of the intersection points of its constituent line segments and by the slopes of its end line segments.

At each of the juncture points (including the station-on and station-off points) means are provided for transmitting to a vehicle the identifying parameters of the next juncture point it will approach. Preferably, the transmission means will include segmented transmission lines at each of the juncture points which communicates with the vehicle through radio transmitters and receivers located on the vehicle which pass close to the transmission lines as the vehicle moves through the guideway. The segmented transmission lines are schematically shown in FIG. 12 as three parallel communication lines 201 which are connected to a wayside computer 202 and transmitter 203 shown in schematic format. The on-board equipment is shown within the schematic outline 200 of the vehicle and includes a receiver 204 for receiving information from the wayside line 201 and a transducer 205 for modifying this information in a digital format to be received by a microprocessor schematically identified at 206 which includes logic 207 to process the information to generate identification of the approaching juncture point and switch logic 208 to generate a command to throw a switch to either the right or the left position. A destination transducer 209 holds coordinates of the destination station and is readable by the switch logic. The command from the switch logic is modified from a transducer 210 to a switch torquer 211 to throw the switch 213. A proximity sensor 212 identifies whether or not the switch has been properly thrown and feeds this information via a transducer 215 back to the switch logic.

The equipment schematically shown in FIG. 12 is known in the art. The switch torquer is preferably such as the switch throw mechanism identified by the numeral 50 in U.S. Pat. No. 4,522,128 to throw the switch shown therein. Proximity sensors are old and well-known in the art and commercially available items. Equipment for transmitting and receiving information across segmented transmission lines are disclosed in a publicly available paper entitled "Odometer Data Downlink Collision Avoidance System Demonstration Report" produced by the Boeing Company and prepared under contract number DOT-UT-80041 with a release date of Aug. 16, 1982.

The information which is transmitted and the logic by which that information is used to control the movement of a vehicle through the network will now be described. When a passenger enters a vehicle at a point of origin, the coordinates of the desired destination station are entered into the destination transducer 209. As the vehicle moves along the path segments, whenever the vehicle passes a juncture point, a wayside transmitter transmits to the vehicle information identifying the type of the next approaching juncture point and parameters concerning that juncture point. More specifically, the vehicle is supplied with information identifying the approaching juncture point as being either a merge point, branch point or station-on point. If the approaching juncture point is a merge point, the vehicle is instructed as to whether it is a merge point which will require left-hand switching or right-hand switching. If the approaching juncture point is a station-on point, the location defining coordinates of the station will be transmitted to the vehicle as well as information whether the station is a right station or a left station. Finally, if the approaching juncture point is a branch point, the wayside transmitter will transmit to the vehicle the parameters which define the network defining line for that branch point.

The information received from the wayside transmitter is fed to the on-board microprocessor 206 which uses the information to determine how to throw a switch. For example, if the approaching juncture point is identified as a being a merge point requiring a left switch, the microprocessor 206 determines whether or not the vehicle is in a left switch mode. If not, the switching mechanism is commanded to switch to the left mode. Likewise, if the approaching junction point is identified as being a merge point requiring a right switch, the microprocessor determines whether the switch is in a right mode and, if not, executes a command to effect switching to the right position.

If the approaching juncture point is a station-on point, the on-board microprocessor compares the location defining coordinates of the approaching station to the location defining coordinates of the destination station. If the coordinates are identical, the microprocessor commands the switch to be thrown in either a right or left mode depending on whether the station is a right station or left station, respectively.

If the approaching juncture point is a branch point, the microprocessor 206 performs an algebraic algorithm to compare the location defining coordinates of the designation station and the coordinates of the intersections of the constituent line segments of the network dividing line and the slopes of the end segments of the network dividing line. The algorithm determines whether the coordinates lie on the right domain R or left domain L of the branch point. If the coordinates of the destination station are in the right domain R, the microprocessor executes necessary commands to insure that the switch is thrown to the right. Alternatively, if the coordinates are in the left domain L, the microprocessor executes switch left commands.

The algorithm may be described by reference to a vehicle having a destination with coordinates $(X_D, Y_D)$ and approaching a branch point having a network dividing line consisting of up to three line segments having intersection points with coordinates $(X_1,Y_1)$ and $(X_2,Y_2)$. The line segments are shown in FIG. 14. The slopes of the line segments are $S_1$, $S_2$ and $S_3$. The equations for the three lines are:

$$Y=S_1(X-X_1)+Y_1=S_1X+B_1,\ B_1=Y_1-S_1X_1 \quad (1)$$

$$Y=S_2(X-X_1)+Y_1=S_2X+B_2,\ B_2=Y_1-S_2X_1 \quad (2)$$

$$Y=S_3(X-X_2)+Y_2=S_3X+B_3,\ B_3=Y_2-S_3X_2 \quad (3)$$

Where $B_1$, $B_2$ and $B_3$ are the intersection on the Y axis of the lines having slopes $S_1$, $S_2$ and $S_3$, respectively.

If a branch point has a network dividing line which consists only of the line segment having the slope $S_1$, the branch point information transmitted to the vehicle will be the parameters $S_1$, $X_1$ and $Y_1$. The microprocessor 206 will use this information to generate a comparison point $Y^*$, where $Y^*=S_1X_D+B_1$. $Y_D$ is compared to $Y^*$ so generated and if $Y_D$ is greater than $Y^*$, for the particular branch point, this will indicate whether or not $Y_D$ is to the left or to the right. Accordingly, the microprocessor determines that the point is in the right or left domain.

If the network dividing line for the branch point comprises two line segments having the slopes $S_1$ and $S_2$, the wayside will transmit the parameters $S_1$, $X_1$, $Y_1$, $S_2$ to the vehicle microprocessor. The microprocessor compares $X_D$ to $X_1$ and if $X_D$ is smaller, the problem is treated identical to that of the single line segment with the processor computing $Y^*=S_1X_D+B_1$. If $X_D$ is greater than or equal to $X_1$, the processor computes $Y^*=S_2X_D+B_2$. The comparison between $Y_D$ and $Y^*$ and the remaining logical steps are as above.

If the branch point dividing line has three line segments with slopes S1, S2 and S3, the identifying parameters of $S_1$, $X_1$, $Y_1$, $X_2$, $Y_2$ and $S_3$ are transmitted to the vehicle microprocessor. The microprocessor computes $S_2$ and compares $X_D$ to $X_2$. If $X_D$ is less than $X_2$, the problem is treated identical to that of a network dividing line having two line segments as described above. If $X_D$ is greater than or equal to $X_2$, $Y^*$ is computed as being equal to $S_3X_D+B_3$ with the comparison between $Y_D$ and $Y^*$ being as above.

An ambiguity can exist depending on whether a vehicle approaches a branch point from the left or the right when viewed in the drawings. For example, a vehicle approaches branch point 16 from the right. In this case, the right domain R is above the network dividing line $\mathbf{100}_{16}$ (FIG. 3). Conversely, a vehicle approaches branch point 17 from the left. In this case, the right domain R is below the network dividing line $\mathbf{100}_{17}$ (FIG. 8). Therefore, the vehicle must be transmitted one additional item of binary information as it approaches a branch point. Namely, having determined whether the destination coordinates $(X_D,Y_D)$ lie above or below the network dividing line, the vehicle must be instructed whether a right or left turn is required. For vehicles approaching from the left, a left turn is required for all destination stations where the Y-coordinate $Y_D$ of the station is large. (That is, where $Y_D$ is greater than a Y-coordinate of a point on the dividing line having an X-coordinate equal to $X_D$). The determination of whether $Y_D$ is large (as defined above) is a matter of simple algebra and is readily made by the microprocessor 206 once the line defining parameters are known. Conversely, for a vehicle approaching from the right, a right turn is required for all destination stations where $Y_D$ is large. (Again, $Y_D$ is defined as being large where $Y_D$ is greater than a Y-coordinate of a point on the dividing line having an X-coordinate equal to $X_D$). Therefore, the vehicle must be transmitted a binary variable of alternatives Type A or Type B where Type A indicates a right turn is required if $Y_D$ is large and Type B indicates a left turn is required if $Y_D$ is large. By way of example, branch point 16 is a Type A branch point and branch point 17 is a Type B branch point.

From the foregoing, it can be seen that the logic can accommodate a network dividing line made up of a plurality of line segments. For each additional line segment, an additional intersecting segment coordinate point and an additional slope must be submitted to the vehicle and an additional step must be made in the logic. This is a very small requirement in that each addition of a line segment will result in requiring only a single programming step being added to the logic. Accordingly, the on-board computer can readily handle networks which would include network dividing lines having many line segments.

Figure 13A:
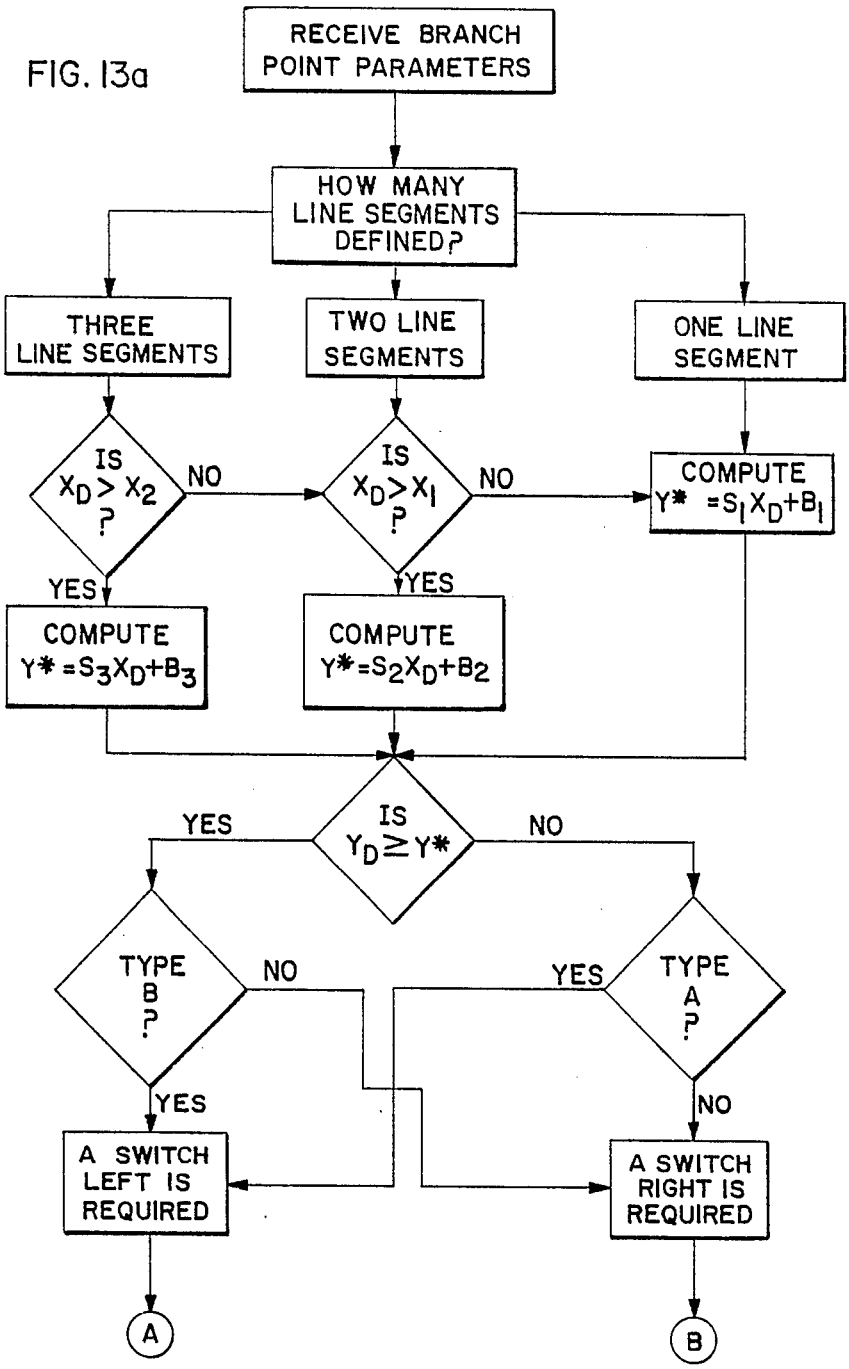
FIGS. 13*a* and 13*b* show a flow chart showing logic for controlling the direction of a vehicle at a branch point.
Figure 13B:
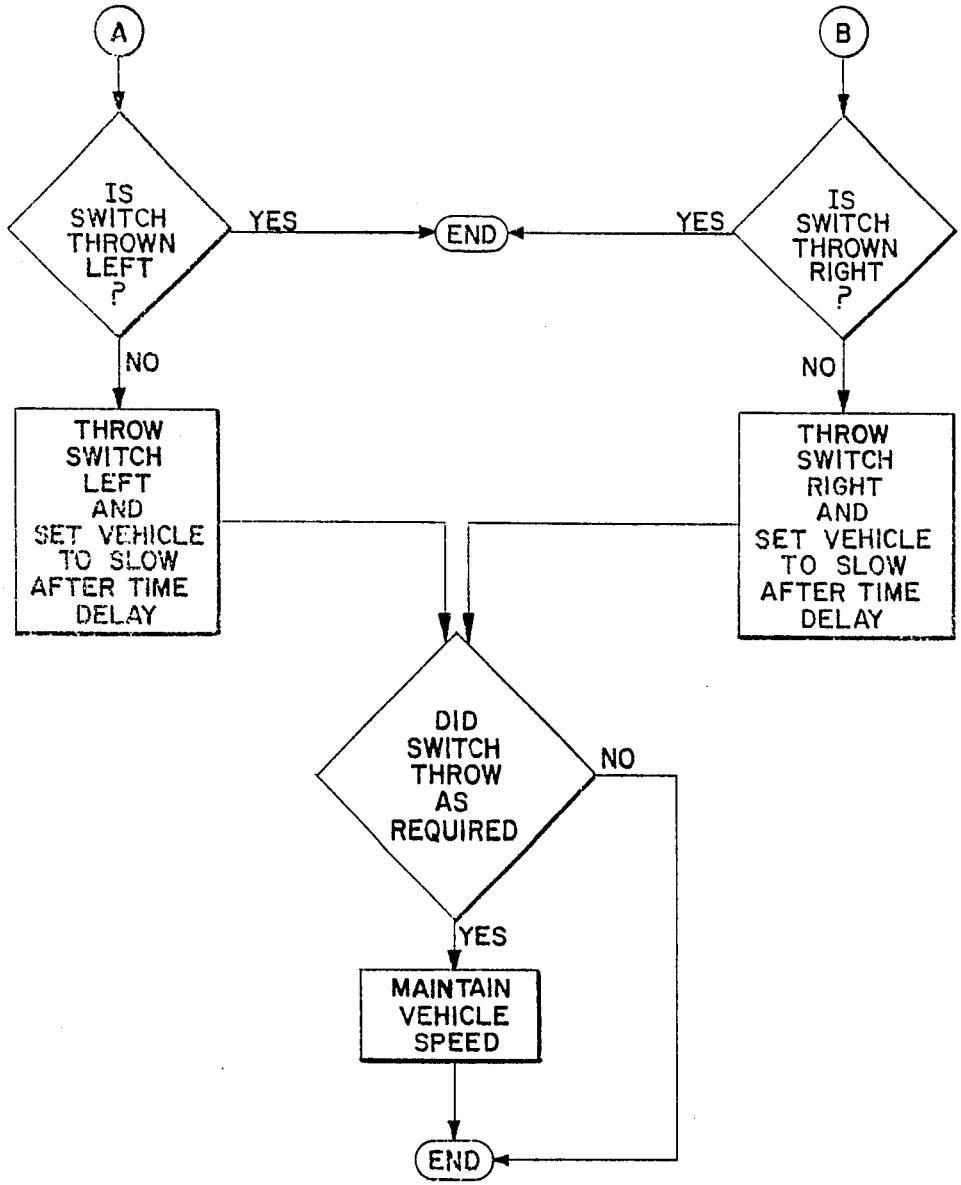

The switch logic performed by the microprocessor is shown in FIGS. 13*a* and 13*b*. If a switch left is required, the microprocessor determines from the proximity sensor 212 whether the switch is thrown left. If it already is in a left position, nothing further need be done. If not, a signal is given to throw the switch to the left and to automatically set the vehicle to slow down after a predetermined time delay. After this command is given, the proximity sensor is analyzed to see if the switch was thrown as required. If it was, the vehicle is given a command to maintain vehicle speed signal which overrides the slow down signal and interrupts the time delay. At this point, no further action is taken until the next juncture point is reached. If the switch was not thrown as required, after the previous described time delay, the vehicle will slow down to a safe speed so the problem can be resolved. Comparative logic is shown for a switch right requirement.

In the foregoing examples, it will be appreciated where there are a plurality of line segments connected to form the network dividing line, only the slopes of the end line segments, the points of intersection and the turn alternative (Type A or Type B) need be transmitted to the vehicle. Although slopes of intermediate line segments may be necessary in performing the above described algorithm, on-board logic can easily derive these intermediate slopes from the transmitted information. For example, if the on-board computer is programmed to receive the information in the predetermined sequence of the intersection point having the smallest X value to the point having the largest point value, the intermediate line segment slopes can be determined through simple algebra.

Having described the network, its equipment and logic, the method of the present invention will be described with reference to a particular example where a passenger enters a vehicle at station 43 and desires to proceed to station 37. In the initial position with a vehicle at rest a station 43, the vehicle has already passed a juncture point and received transmitted information regarding the next juncture point. Namely, the vehicle has passed the station-on point for station 43 and received information that the next juncture point is a station-off point which merges from the right of a pathway. Accordingly, the vehicle switch will be in a switch right mode.

A passenger desiring to travel to station 37 enters the vehicle at station 43 and through any suitable means such as magnetic card, keyboard or otherwise informs the vehicle of the coordinates of the destination station 37 (these coordinates will be referred to as $(X_{37},Y_{37})$. With the destination coordinates encoded, the vehicle proceeds onto the path segment extending between points 14 and 26. After the vehicle passes the station-off point for station 43, the identifying information and parameters for the upcoming junction point 26 are transmitted to the vehicle. In this example, the vehicle will receive information that the next juncture point is a merge point and requires a switch right mode. Since the vehicle is already in a switch right mode, no further action is taken until after juncture point 26 is passed and identification information and parameters for the next approaching juncture point 15 are received. This information identifies juncture point 15 as a Type A branch point with the network dividing line $\mathbf{100}_{15}$ (as shown in FIG. 2) having the defining parameters of $S_{15'}$, $X_{15}$, $Y_{15}$ and $S_{15}$. The on-board microprocessor performs the above described logic to compare these parameters to the destination coordinates $X_{37}$ and $Y_{37}$. Determing these coordinates to lie in the left domain L of the network, the microprocessor commands the switching mechanism to switch to a left mode.

After passing branch point 15, the on-board computer is transmitted information concerning the next approaching juncture point which is a station-on point for station 44. The transmitted information includes information identifying the upcoming point as a station-on point which is for a left-handed station and also provide the on-board computer with the coordinates of the station which will be referred to as $(X_{44},Y_{44})$. The on-board computer compares these coordinates to the destination coordinates $(X_{37},Y_{37})$ and notes they are not identical and, accordingly, switches the switch to a right mode to avoid entry onto station 44. Also, at this point, the on-board logic informs the microprocessor that the next approaching juncture point is a station-off point and the right switch mode should be maintained. When passing the station-off point, information concerning the next approaching juncture point 25 is transmitted to the vehicle. The transmitted information will indicated that juncture point 25 is a merge point requiring the vehicle to be in a switch left mode. Noting that the vehicle is currently in a switch right mode, a command will be issued switching the vehicle to a switch left mode.

When juncture 25 is passed, information will be transmitted to the vehicle concerning the next approaching juncture 16. The transmitted information will be that juncture 16 is a Type A branch point having a network dividing line $\mathbf{100}_{16}$ (shown in FIG. 3) with line defining parameters of $S_{16}$, $X_{16}$, $Y_{16}$, $X_{16'}$, $Y_{16'}$ and $S_{16'}$. With these parameters, the on-board microprocesor will perform the above described logic and determine that the coordinates $(X_{37},Y_{37})$ of the destination station lie in the right domain R of the network and will command the switch mechanism to assume a switch right mode.

After passing juncture point 16, the vehicle will receive information concerning the next approaching point. The information the vehicle will receive is that the next approaching point is a station-on point for a right-handed station having location defining coordinates of $X_{37}$, $Y_{37}$. The on-board microprocessor will compare these coordinates to the coordinates $(X_{37},Y_{37})$ of the destination station and will determine that these coordinates are identical. Informed that the station is a right-hand station, the microprocessor will note that the vehicle is already in a right switch mode and will maintain the vehicle in a right switch mode to enter the station 37 at which point the desired trip will be completed.

From the foregoing, it can be seen how vehicle movement through a network can be controlled according to the method and apparatus of the present invention. Specifically, it can be seen that the amount of programming for the on-board computer is minimal and that the amount of necessary information transmitted between the vehicle and a wayside station is small. The only transmission to the vehicle is transmission of the destination coordinates at the point of origin and the parameters of approaching juncture points.

The present invention is particularly suitable to transportation networks where the network structure is subject to change. For example, additional stations and additional path segments may be added. As path segments and stations are added, network dividing lines for any given branch point may change. However, there is no need to change any of the on-board logic for the vehicles. All that is changing are the parameters which will be fed to the vehicle as it passed the preceding juncture point. Reshaping and defining the parameters of the network defining line for any given branch point is a very simple task. For small networks it can be done manually. For very large networks, it would be well within the skill of the art to provide computer programs which will find the most efficient layout for the network dividing lines based on input parameters such as minimizing transportation time between the branch point and the destination station.

In light of the ease by which the system can be modified simply by changing the line defining parameters for the individual branch points, the system is very well suited to handle troublesome problems such as congestion or need for rerouting due to accidents or damage to a path segment. Anticipating that a central logic unit will receive information concerning the location of vehicles and their destinations, such a unit can easily determine in advance whether a particular path segment will approach an unreasonably congested state. If a central logic unit so determines that a path segment will, in the future, be at its saturated state, then, as to future passengers, the vehicles can be rerouted away from the potentially troublesome path segment. This is easily done by providing each of the branch points 10–17 with alternate line-defining parameters. For example, branch point 16 could be provided with an alternate network dividing line $\mathbf{100}_{16'}$ (shown in FIG. 9) which is established assuming the path segment between juncture points 13 and 23 is no longer available. In the event a central computing unit determines that the path segment between points 13 and 23 is becoming close to being congested, the central computing unit can modify the information at the wayside transmitter at juncture point 25 such that a vehicle passing juncture point 25 will be transmitted line defining parameters $S_{16a}$, $X_{16b}$, $Y_{16b}$, $X_{16a}$, $Y_{16a}$ and $S_{16a'}$. As a result of this modification of information at juncture point 25, all vehicles passing this juncture point and approaching branch point 16 will be directed at branch point 16 in a direction for most effecient travel to a destination point assuming that path segment 13–23 is unavailable for travel. Once the potential for congestion on the path segment between points 13 and 23 has passed, the central computing unit can replace the substituted information at juncture point 25 with the parameters of line $100_{16}$ (shown in FIG. 3).

As a result of the foregoing, it can be seen how the objects of the present invention have been achieved in a preferred manner. The amount of information which must be transmitted from a stationary point to the moving vehicle is held to a minimum to thereby insure only accurate transmission without error is sent to the vehicle. Also, since it is an easy task to establish and change the network dividing lines in response to changes in the network, this system is very flexible to permit growth of the network and to accommodate changes in congestion and delay. While the preceding is a preferred embodiment, it will be appreciated that the scope of the invention is intended to include such modifications and equivalents of the disclosed concepts as will appear to those skilled in the art. Accordingly, it is intended that the scope of the present invention only be limited by the scope of the claims which are appended hereto.

What is claimed is:

1. A method of controlling movement of a vehicle through a network having a plurality of stations interconnected by a plurality of path segments, a plurality of juncture points connecting said path segments, said plurality of juncture points comprising a plurality of branch points requiring a vehicle approaching a branch point to be directed in either a first or second direction, the method comprising the steps of:

(a) establishing a coordinate system for said network;

(b) assigning location-defining coordinates to each of said stations;

(c) identifying line-defining parameters for each of said branch points with said parameters defining a dividing line through said network with said line dividing said plurality of stations into a first set of stations preferably attainable according to predetermined selection by a vehicle being directed in a predetermined first direction at said branch point and a second set of stations preferably attainable according to predetermined selection by a vehicle being directed in a predetermined second direction at said branch point;

(d) associating location-defining coordinates of a destination station with a vehicle;

(e) moving said vehicle along a path segment toward an approaching branch point;

(f) comparing said location-defining coordinates of said destination station to line-defining parameters of said approaching branch point and determining whether said destination station is a member of a first set or a second set for said approaching branch-point; and (g) directing said vehicle in said first direction if said destination station is determined to be a member of said first set and in said second direction if said station is determined to be a member of said second set.

2. A method according to claim 1 further comprising: identifying alternative line-defining parameters for each of said branch points with said alternative parameters defining an alternative line through said network with said line dividing said plurality of stations into a first set attainable by a vehicle directed in a first direction at said branch point and assuming a predetermined path segment is closed to vehicle traffic and a second set attainable by a vehicle directed in a second direction at said branch point and assuming said predetermined path segment is closed to vehicle traffic.

3. A method according to claim 2 comprising identifying a plurality of alternative line-defining parameters for each of said branch points with each one of said plurality defining a network dividing line assuming a different predetermined path segment is closed to vehicle traffic.

4. A method according to claim 1 wherein said line dividing said plurality of stations is a straight line and said parameters comprise a slope of said line and coordinates of a point on said line.

5. A method according to claim 1 wherein said line dividing said plurality of stations is a plurality of connected line segments with said parameters comprising coordinates of intersections of said line segment and slopes of line segments at ends of said dividing line.

6. A transportation network comprising:

(a) a plurality of stations;

(b) a plurality of path segments connecting said stations;

(c) a plurality of branch points connecting said path segments;

(d) a plurality of location-defining coordinates associated with said stations;

(e) a plurality of line-defining parameters for said branch points with said parameters defining a dividing line through said network and dividing said plurality of stations into a first set preferably attainable according to predetermined selection by a vehicle being directed in a predetermined first direction at said branch point and a second set preferably attainable according to predetermined selection by a vehicle being directed in a predetermined second direction at said branch point;

(f) a vehicle disposed on said network for movement along said path segments;

(g) means for associating location-defining coordinates of a destination station with said vehicle;

(h) means for comparing said location-defining coordianates of said destination station with said line-defining parameters and determining if said destination station is a member of a first set or a second set;

(i) means for alternatively directing said vehicle to said first and second directions.

7. A network according to claim 6 comprising:

means for transmitting line-defining parameters of an approaching branch point to said vehicle.

8. A network according to claim 7 wherein further comprising a plurality of merge points with a vehicle at a merge point required to be directed in a predetermined direction, said plurality of merge points and said plurality of branch points collectively comprising a plurality of juncture points:

means for transmitting to a vehicle approaching a juncture point information defining said juncture point as a branch point or a merge point.

9. A network according to claim 7 wherein further comprising a plurality of station-on points connecting a station with a path segment and with a vehicle at a station-on point required to be directed in a predetermined required direction to arrrive at said station, said plurality of station-on points and said plurality of branch points collectively comprising a plurality of juncture points;

means for transmitting to a vehicle approaching a juncture information definining said juncture point as a branch point or a station-on point.

10. A method of controlling movement of a vehicle to a desired destination in a network having a plurality of stations assigned location-defining coordinates and interconnected by a plurality of path segments having a plurality of juncture points connecting said segments, said plurality of juncture points comprising a plurality of branch points, said branch points having associated line-defining parameters defining a dividing line through said network which divides said plurality of stations into a first set of stations preferably attainable according to predetermined selection by a vehicle being directed in a predetermined first direction and a second set of stations preferably attainable according to predetermined election by a vehicle being directed in a second direction, said network further including transmission and receiving means for transmittiing information to a vehicle, computing means associated with a vehicle for analyzing information received by a vehicle and means for directing said vehicle in a first or second direction; said method comprising the steps of:

(a) transmitting to said vehicle location-defining coordinates of said destination station;

(b) moving said vehicle along a path segment toward an approaching branch point;

(c) transmitting to said vehicle line-defining parameters of a dividing line associated with said approaching branch point;

(d) comparing said coordinates of said destination station to said line-defining parameters and determining whether said destination station is a member of a first or second set for said approaching branch points; and (e) directing said vehicle in said first direction if said destination station is determined to be a member of said first set and in said second direction if said station is determined to be a member of said second set.

11. In the method of claim 10 wherein said plurality of juncture points further comprises a plurality of merge points with a vehicle at a merge point required to be directed in a predetermined required direction; the method further comprising the steps of:

(a) moving said vehicle toward a juncture point;

(b) transmitting to said vehicle information defining said juncture point as a branch point or merge point; and (c) directing said vehicle in said predetermined required direction if said juncture point is a merge point.

12. In the method of claim 10 wherein said plurality of juncture points further comprises a plurality of station-on points connecting a station with a path segment with a vehicle at a station-on point required to be directed in a predetermined required direction to arrive at said station; the method further comprising the steps of:

(a) moving said vehicle toward a juncture point;

(b) transmitting to said vehicle information defining said juncture point as a branch point or station-on point; and (c) directing said vehicle in said predetermined required direction if said juncture point is a station-on point.

* * * * *

UNITED STATES PATENT AND TRADEMARK OFFICE

CERTIFICATE OF CORRECTION

PATENT NO. : 4,726,299

DATED : February 23, 1988

INVENTOR(S) : Anderson

It is certified that error appears in the above-identified patent and that said Letters Patent is hereby corrected as shown below:

Column 1, line 21, "constant. stopping" should be --constant stopping--;

Column 6, line 35, "by a taking a left turn" should be --by taking a left turn--;

Column 11, line 47, "will indicated" should be --will indicate--;

Column 11, line 58, "microprocesor" should be --microprocessor--;

Column 15, line 5, "a desired destination in a network" should be --a desired destination station in a network--;

Column 15, line 16, "predetermined election" should be --predetermined selection--;

UNITED STATES PATENT AND TRADEMARK OFFICE

CERTIFICATE OF CORRECTION

PATENT NO. : 4,726,299

DATED : February 23, 1988

INVENTOR(S) : Anderson

It is certified that error appears in the above-identified patent and that said Letters Patent is hereby corrected as shown below:

Column 15, line 19, "transmiitting" should be --transmitting--;

Column 16, line 2, "points" should be --point--.

Signed and Sealed this

Twelfth Day of July, 1988

*Attest:*

*Attesting Officer*

DONALD J. QUIGG

*Commissioner of Patents and Trademarks*